US007789327B2

(12) United States Patent
Micheli et al.

(10) Patent No.: US 7,789,327 B2
(45) Date of Patent: Sep. 7, 2010

(54) MODULAR SPRAY GUN WITH REPLACEABLE COMPONENTS

(75) Inventors: Paul R. Micheli, Glen Ellyn, IL (US); Christine Laub, Carol Stream, IL (US); Nekheel Gajjar, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 222 days.

(21) Appl. No.: 11/809,166

(22) Filed: May 31, 2007

(65) Prior Publication Data

US 2008/0295768 A1 Dec. 4, 2008

(51) Int. Cl.

| | |
|---|---|
| ***B05B 7/02*** | (2006.01) |
| ***B05B 1/28*** | (2006.01) |
| ***B05B 1/00*** | (2006.01) |
| ***B05B 7/12*** | (2006.01) |

(52) U.S. Cl. ..... 239/526; 239/290; 239/296; 239/379; 239/600

(58) Field of Classification Search ..... 239/290, 239/296, 340, 341, 345, 346, 525–528, 600, 239/690, 690.1, 691, 379
See application file for complete search history.

(56) References Cited

U.S. PATENT DOCUMENTS

| | | | | |
|---|---|---|---|---|
| 1,511,361 | A | 10/1924 | Paasche | |
| 1,840,488 | A | 3/1930 | Connell | |
| 4,518,122 | A | 5/1985 | Ballu | |
| 4,660,774 | A | 4/1987 | Kwok et al. | |
| 4,993,642 | A * | 2/1991 | Hufgard | 239/300 |
| 5,395,046 | A | 3/1995 | Knobbe et al. | |
| 5,765,753 | A | 6/1998 | Kieffer | |
| 5,947,388 | A | 9/1999 | Woodruff | |
| 6,019,294 | A | 2/2000 | Anderson et al. | |
| 6,098,902 | A | 8/2000 | Culbertson et al. | |
| 6,467,705 | B2 * | 10/2002 | Robidoux | 239/697 |
| 6,508,415 | B2 | 1/2003 | Wang | |
| 6,511,001 | B1 | 1/2003 | Huang | |
| 6,702,198 | B2 | 3/2004 | Tam et al. | |
| 6,719,212 | B1 | 4/2004 | Leisi | |
| 6,854,667 | B2 | 2/2005 | Ulrich et al. | |
| 6,874,702 | B2 | 4/2005 | Turnbull | |
| 7,032,839 | B2 | 4/2006 | Blette et al. | |
| 2003/0006322 | A1 * | 1/2003 | Hartle et al. | 239/691 |
| 2005/0072860 | A1 * | 4/2005 | Fedorov | 239/346 |
| 2005/0284963 | A1 * | 12/2005 | Reedy | 239/526 |
| 2006/0049283 | A1 | 3/2006 | Lee | |

FOREIGN PATENT DOCUMENTS

| | | |
|---|---|---|
| DE | 562872 | 10/1932 |
| EP | 0804969 A2 | 11/1997 |

* cited by examiner

*Primary Examiner*—Darren W Gorman
(74) *Attorney, Agent, or Firm*—Fletcher Yoder

(57) ABSTRACT

A system, in certain embodiments, may include a spray coating device leaving a plurality of casings coupled together to define an exterior contour and a hollow interior of the spray coating device. The spray coating device also may include a plurality of modular components disposed in the hollow interior, wherein the plurality of modular components are configured to cooperate with one another output a spray coating.

20 Claims, 8 Drawing Sheets

MODULAR SPRAY GUN WITH REPLACEABLE COMPONENTS

BACKGROUND

The present technique relates generally to spray coating devices, such as spray guns used to apply paint and other finishing products onto a product. More specifically, the present technique relates to manufacturing, repair, and servicing of these spray coating devices.

Spray coating devices typically include a variety of fixed or integrated components, such as air and liquid valves, passages, orifices, and so forth. For example, the components of the spray coating device may be permanently coupled and/or fused with one another during manufacturing and/or assembly, such that it may be difficult to disassemble or reassemble those components for servicing and repair. Further, if any of the aforementioned components fail during operation, then replacing such components may also require replacing components which otherwise may be operable and/or which may not require replacement. Moreover, the permanent nature by which components of the spray coating device may be coupled with one another may require, in some circumstance, replacing the entire spray coating device even though only individual components may need replacement. In addition, each spray coating device may have components that are incompatible with other spray coating devices due to different form factors, connectors, and so forth. Thus, each spray coating device must be repaired with components specific to that particle device.

In addition, maintaining the spray gun may require regularly cleaning its components, for example, between spray coating operations. Such maintenance is typically undertaken in order to remove paint and/or other residue, which may have dried and/or solidified onto the inner components of the spray coating device. Maintaining the spray coating device and its inner component may be a cumbersome task, especially when the components of the spray coating device are permanently coupled to one another. For example, the difficultly or impossibility of accessing certain interior components may result in a deprivation of regular cleaning and other maintenance.

BRIEF DESCRIPTION

A system, in certain embodiments, may include a spray coating device having a plurality of casings coupled together to define an exterior contour and a hollow interior of the spray coating device. The spray coating device also may include a plurality of modular components disposed in the hollow interior, wherein the plurality of modular components are configured to cooperate with one another output a spray coating.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
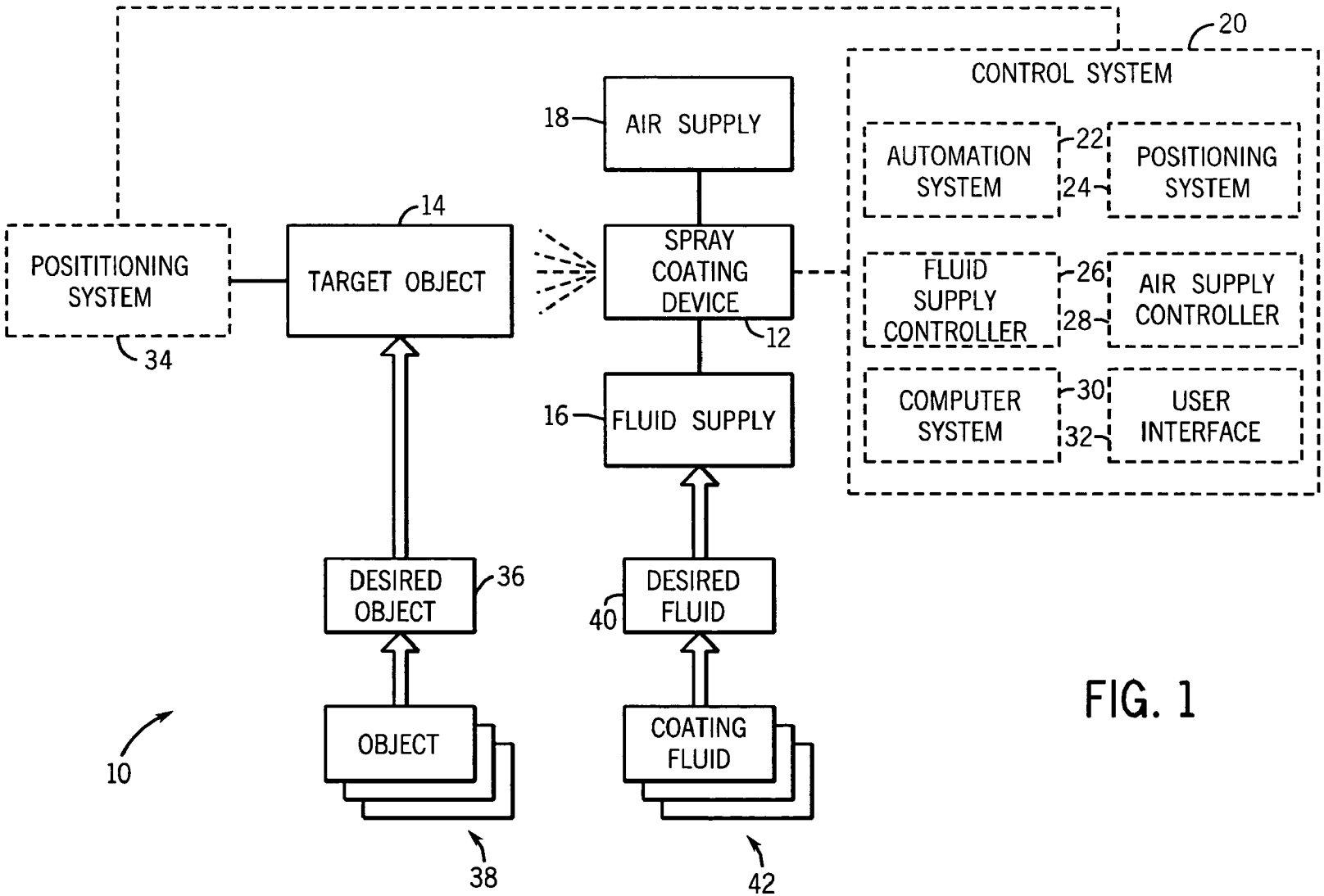
FIG. 1 is a diagram illustrating an embodiment of a spray coating system.

FIG. 1 is a flow chart illustrating an embodiment of a spray coating system 10, which includes a spray coating device 12 (e.g., spray gun) for applying a desired coating to a target object 14. For simplicity, the spray coating device 12 will be described as a spray gun in the following description, although various embodiments of the spray coating device 12 may or may not have a gun-shaped body. As discussed in further detail below, the spray gun 12 may have a split case having receptacles configured to support a plurality of modular components, such as an air valve, a liquid valve, conduits, levers, and so forth. In some embodiments, each module is a self-contained functional unit, which includes a housing surrounding functional elements, passages, seals, valves, or other elements. As a result, each unit can be easily assembled and disassembled within the split case to add, remove, or change the functionality without the complication of many small parts typically associated with the unit. Thus, the modular components can be quickly and easily accessed, replaced, repaired, or serviced at any time.

Moreover, the modular components can be used for a plurality of different types and configurations of spray coating devices, e.g., 12, such that a manufacturer/supplier can reduce the amount of parts and associated costs with manufacturing and providing replacement parts for various spray coating devices. For example, any number of modular components may be assembled with a particular split case, and any number of split cases may be assembled with each modular component. The spray gun 12 also can be quickly reconfigured with different modular components to configure the device 12 for a particular application. For example, the spray gun 12 may have a first atomization head for a base coat, a second atomization head for a paint, a third atomization head for a clear coat, and so forth. By further example, the device 12 may be configured to support a plurality of alternative atomization mechanisms, such as a rotary atomizer module, an air assisted atomizer module, or a fluid-only atomizer modular (e.g., without air assistance). The device 12 also may be configured to support a plurality of alternative air heads, which may include different types of air shaping jets configured to provide different shapes of sprays. Another example would be a plurality of different types of valves, such as a spring-assisted valve or an air-assisted valve. The modular features of the spray gun 12 are discussed in further detail below with reference to FIGS. 3-8.

The illustrated spray gun 12 may be coupled to a variety of supply and control systems, such as a fluid supply 16, an air supply 18, and a control system 20. The control system 20 facilitates control of the fluid and air supplies 16 and 18 and ensures that the spray gun 12 provides an acceptable quality spray coating on the target object 14. For example, the control system 20 may include an automation system 22, a positioning system 24, a fluid supply controller 26, an air supply controller 28, a computer system 30, and a user interface 32. The control system 20 also may be coupled to a positioning system 34, which facilitates movement of the target object 14 relative to the spray gun 12. According, the spray coating system 10 may provide a computer-controlled mixture of coating fluid, fluid and air flow rates, and spray pattern. Moreover, the positioning system 34 may include a robotic arm controlled by the control system 20, such that the spray gun 12 covers the entire surface of the target object 14 in a uniform and efficient manner.

Spray coating system 10 of FIG. 1 is applicable to a wide variety of applications, fluids, target objects, and types/configurations of the spray gun 12. For example, a user may select a desired fluid 40 from a plurality of different coating fluids 42, which may include different coating types, colors, textures, and characteristics for a variety of materials such as metal and wood. The user also may select a desired object 36 from a variety of different objects 38, such as different material and product types. As discussed in further detail below, spray gun 12 also may comprise a variety of different components and spray formation mechanisms to accommodate target object 14 and fluid supply 16 selected by the user. For example, the spray gun 12 may comprise an air atomizer, a rotary atomizer, an electrostatic atomizer, or any other suitable spray formation mechanism.

Figure 2:
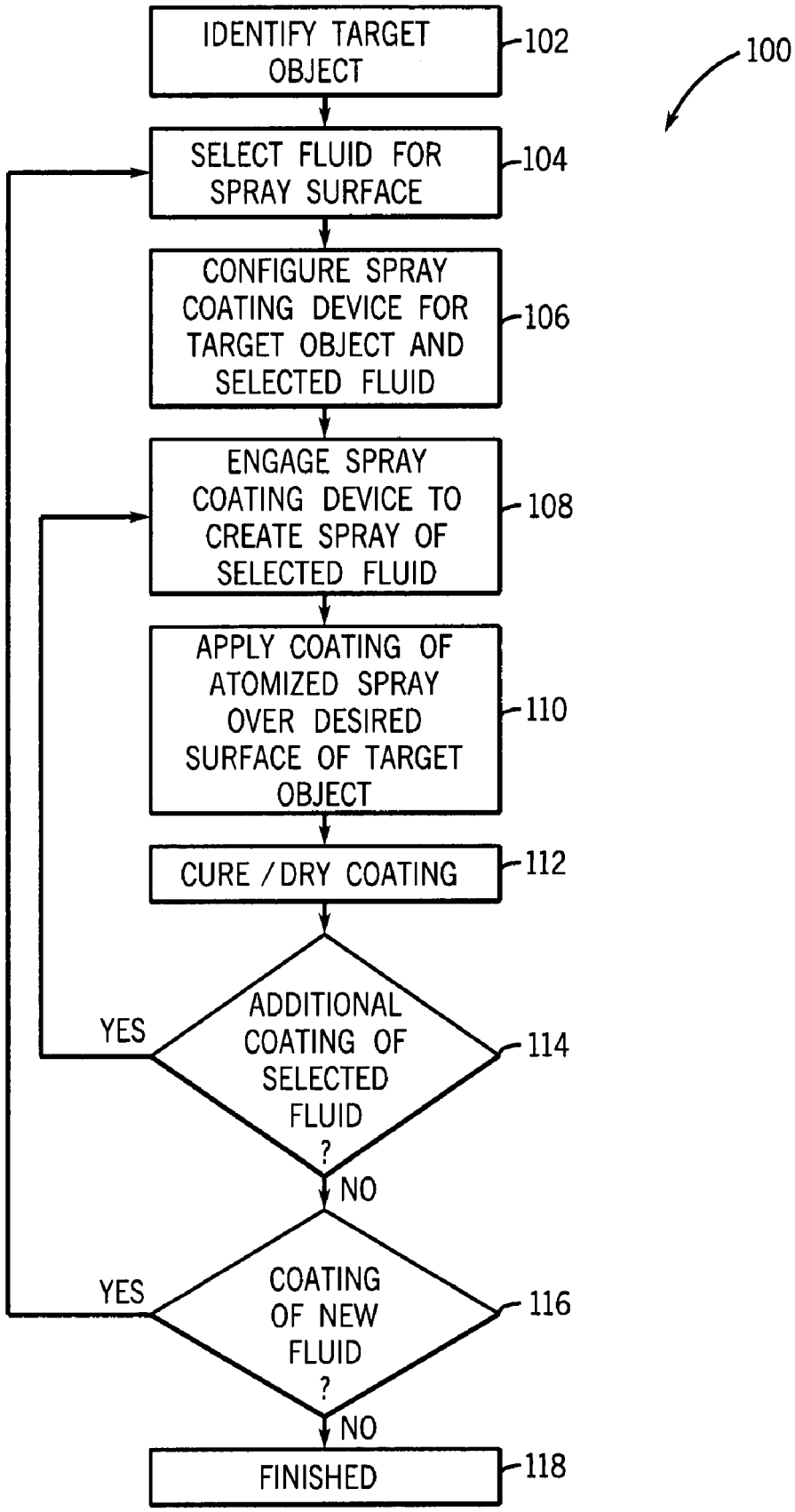
FIG. 2 is a flow chart illustrating an embodiment of a spray coating process.

FIG. 2 is a flow chart of an embodiment of a spray coating process 100 for applying a desired spray coating to the target object 14. As illustrated, process 100 proceeds by identifying target object 14 for application of the desired fluid (block 102). Process 100 then proceeds by selecting desired fluid 40 for application to a spray surface of the target object 14 (block 104). A user may then proceed to configure spray gun 12 for the identified target object 14 and selected fluid 40 (block 106). As the user engages spray gun 12, process 100 then proceeds to create an atomized spray of selected fluid 40 (block 108). The user may then apply a coating of the atomized spray over the desired surface of target object 14 (block 110). Process 100 then proceeds to cure/dry the coating applied over the desired surface (block 112). If an additional coating of selected fluid 40 is desired by the user at query block 114, then process 100 proceeds through blocks 108, 110, and 112 to provide another coating of the selected fluid 40. If the user does not desire an additional coating of the selected fluid at query block 114, then process 100 proceeds to query block 116 to determine whether a coating of a new fluid is desired by the user. If the user desires a coating of a new fluid at query block 116, then process 100 proceeds through blocks 104-114 using a new selected fluid for the spray coating. If the user does not desire a coating of a new fluid at query block 116, then process 100 is finished at block 118.

Figure 3:
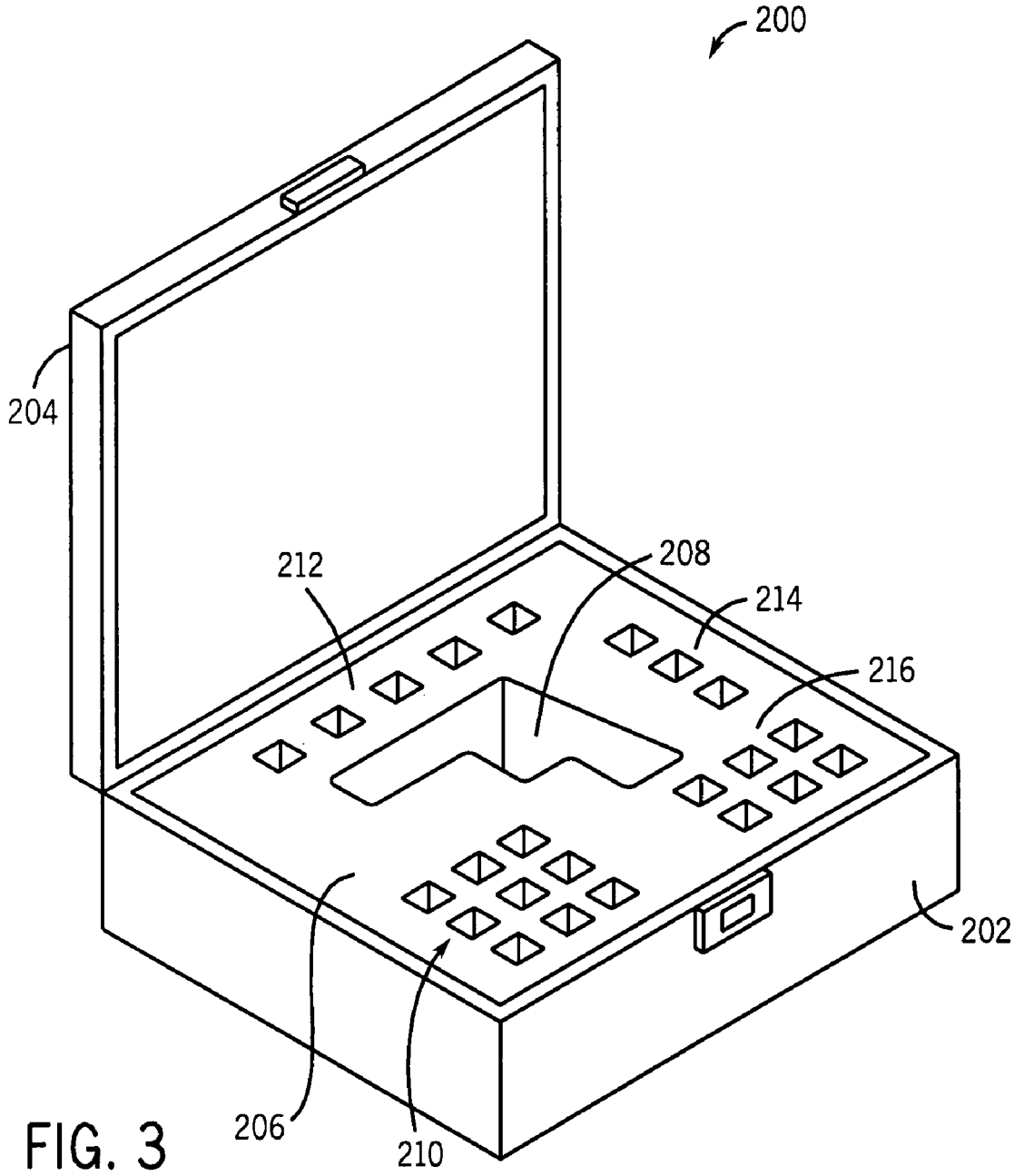
FIG. 3 is a perspective view of an embodiment of a portable storage case adapted to store a spray coating device and associated modular components.

FIG. 3 is a perspective view of an embodiment of a portable storage casing 200 adapted to store the spray gun 12 and associated modular components. Generally, the portable storage casing 200 may be part of the spray coating system describe above in relation to FIGS. 1 and 2, insofar as portable casing 200 may be adapted to carry modular components of the spray gun 12. Accordingly, portable storage casing 200 enables a user to carry the spray gun 12 and its modular components between different locations where spray coating operations are performed. Portable storage casing 200 may thus provide the user with replacement parts on site, thereby enabling the user to replace components of the spray gun 12 during and/or between operations as desired. Portable storage casing 200 is formed of an enclosure 202 and a cover 204. In the illustrated embodiment, the cover 204 may be hinged to one side of the enclosure 202, such that it may rotate to close or open the enclosure 202. In other embodiments, cover 204 may be fitted on or latched to enclosure 202 via one or more latches and a lock adapted to ensure that cover 204 is securely coupled to enclosure 202 as casing 200 is moved and/or handled. In these and other similar embodiments, cover 204 may be decoupled and temporarily removed from enclosure 202.

Enclosure 202 further includes multiple storage compartments disposed about volume 206 of enclosure 202. Such storage compartments are adapted to house replacement components of the spray coating device, so as to maintain those components securely in place as portable casing 200 is moved and/or handled. Accordingly, portable casing 200 may contain modular components of the spray gun 12 used either as replacement parts and/or as alternative add-ons, which may be configured to add/change functionalities of the spray gun 12. Such components may be easily removed from or placed within portable storage casing 200, enabling a user to expediently assemble/dissemble the spray gun 12 and replace any modular components of the spray gun 12 which may have malfunctioned and/or otherwise require maintenance.

For example, storage compartment 208 is adapted to receive modular casing(s), which form the exterior of the spray gun 12. As illustrated, storage compartment 208 generally conforms to the shape of such casing(s) so that the casings may fit snuggly within storage compartment 208. Similarly, storage compartments 210 may be adapted to receive one or more different air valve modules, which may include, for example, pinch valves, tubing, levers, retaining rings, and so forth. Similarly, storage compartment 212 may be adapted to store one or more different trigger module, which may include trigger handles, pivot joints, screws, latches, locks, and so forth. Further, storage compartment 214 may be adapted to store one or more different air/fluid modules, and storage compartments 216 may be adapted to receive one or more different pintle nozzle assemblies. While the illustrated embodiment may show only a subset of the types of storage compartments associated with various modules of the spray gun 12, other embodiments may include a broader array of storage compartments adapted to store additional modules, some of which may be adapted for use with multiple types of spray coating devices and/or applications.

Storage compartments 208-216 may be part of a substrate, such as a tray, disposed within volume 206. For example, in one embodiment, volume 206 may be filled with foam like material having impressions forming storage compartments 208-216. In another embodiment, volume 206 may be filled with a plastic material molded according to the shapes of the modular components stored in compartments 208-216. Still in another embodiment, volume 206 may be occupied by a portable removable tray having storage compartments 208-216, whereby a user may remove the tray out from enclosure 202 and carry the tray to a desired location.

Figure 4:
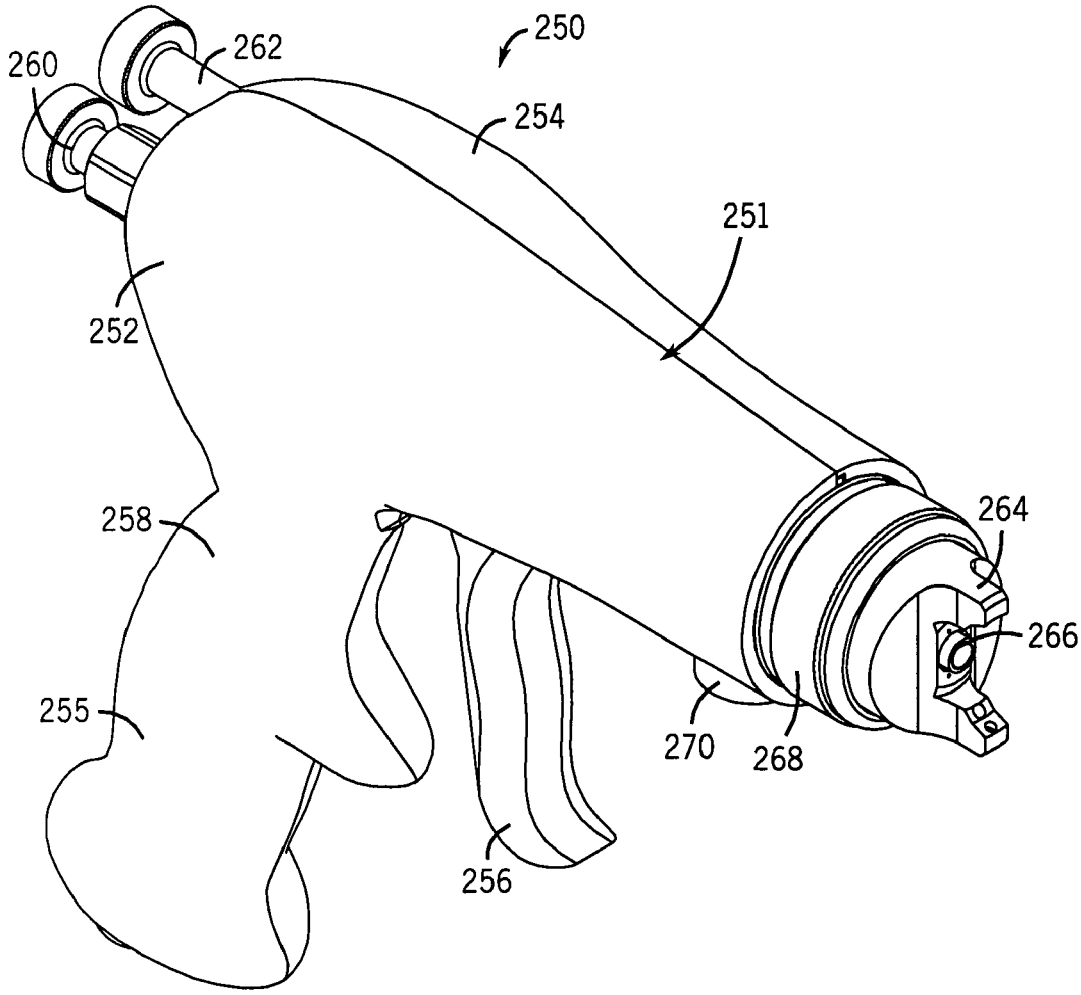
FIG. 4 is a perspective view of an embodiment of an assembled spray coating device.

FIG. 4 is a perspective view of an embodiment of the spray gun 12 as discussed above with reference to FIGS. 1-3, and numbered here as spray coating device or spray gun 250. The illustrated spray gun 250 includes a plurality of modular components within an enclosure 251 defined by a pair of modular casings 252 and 254. The illustrated casings 252 and 254 are generally symmetrical mirrored structures forming the enclosure 251, which encloses and supports the various modular components as mentioned above with reference to FIG. 3. In other embodiments, the enclosure 251 may be defined by a plurality of different modular casings, each having a different shape, size, exterior features, interior features, fasteners, and so forth. Modular casings 252 and 254 may be formed of a lightweight plastic material, a rubber material, a metal such as aluminum, or a combination thereof. Modular casings 252 and 254 may be formed via various molding processes, such as injection or cast molding processes, in which a plastic, rubber, and/or metal may be conformed to the shapes of modular casings 252 and 254. As illustrated, a grip handle 255 is formed when casings 252 and 254 are fully assembled to form the enclosure 251 of spray gun 250. Further, casings 252 and 254 are formed such that grip handle 255 acquires a unique shape, providing users with an ergonomic grip for comfortable handling. Spray gun 250 further includes trigger module 256 disposed adjacent to handle 255. Trigger module 256 may extend from the inner enclosure 251 of spray gun 250, thereby forming an independent component partially within casings 252 and 254. Thus, when split casings 252 and 254 are taken apart, trigger module 256 may remain coupled to inner modular components of spray gun 250.

As further illustrated, spray gun 250 includes a fluid valve adjuster 260 and an air valve adjuster 262, both of which are disposed at the rear portion of spray gun 250. Fluid valve adjuster 260 and air valve adjuster 262 are part of a fluid needle module and a fan control module, respectively, both disposed within enclosure 251 of spray gun 250. Accordingly, fluid valve adjuster 260 and air valve adjuster 262 may not be part of modular casings 252 and 254 to the extent that when casings 252 and 254 are taken apart fluid valve adjuster 260 and air valve adjuster 262 may remain coupled to their respective modules disposed within spray gun 250.

Spray gun 250 further includes an air cap 264 and a fluid tip exit 266, both part of a spray tip module configured to mix spray fluids and pressurized air to form desirable spraying profiles during operation of spray gun 250. The spray tip module may include atomization and fluid break up mechanisms configured to further optimize the manner by which spray is formed as the spray exits spray gun 250. As further illustrated, air cap 264 and fluid tip exit 266 are retained to casings 252 and 254 via retaining ring 268. In the illustrated embodiment, retaining ring 268 also secures the front portions of modular casings 252 and 254, so as to retain those structures together with the head of the spray gun 250, as further described below. In the illustrated embodiment, ring 268 is threaded onto the front portions of modular casings 252 and 254, while other embodiments may use other fasteners.

Spray gun 250 further includes a fluid inlet 270, which in the illustrated embodiment, is disposed adjacent and below retaining ring 268. Fluid inlet 270 is coupleable to a fluid source from which spray fluid may be drawn and channeled through spray gun 250. As will be explained further below, fluid inlet 270 is part of an air/fluid module disposed within spray gun 250. The air/fluid module is adaptable to accommodate various fluid delivery assemblies, such as a fluid pump, an air pressure driven fluid, a gravity driven fluid (e.g., top mounted), and so forth. In the illustrated embodiment, fluid inlet 270 is shown at a bottom side of the enclosure 251, and may couple to a fluid conduit or container pressurized to drive the fluid through spray gun 250. Alternatively, spray gun 250 may have fluid inlet 270 disposed on a top side of enclosure 251, whereby fluid is dropped via gravity from a top mounted container into spray gun 250.

Figure 5:
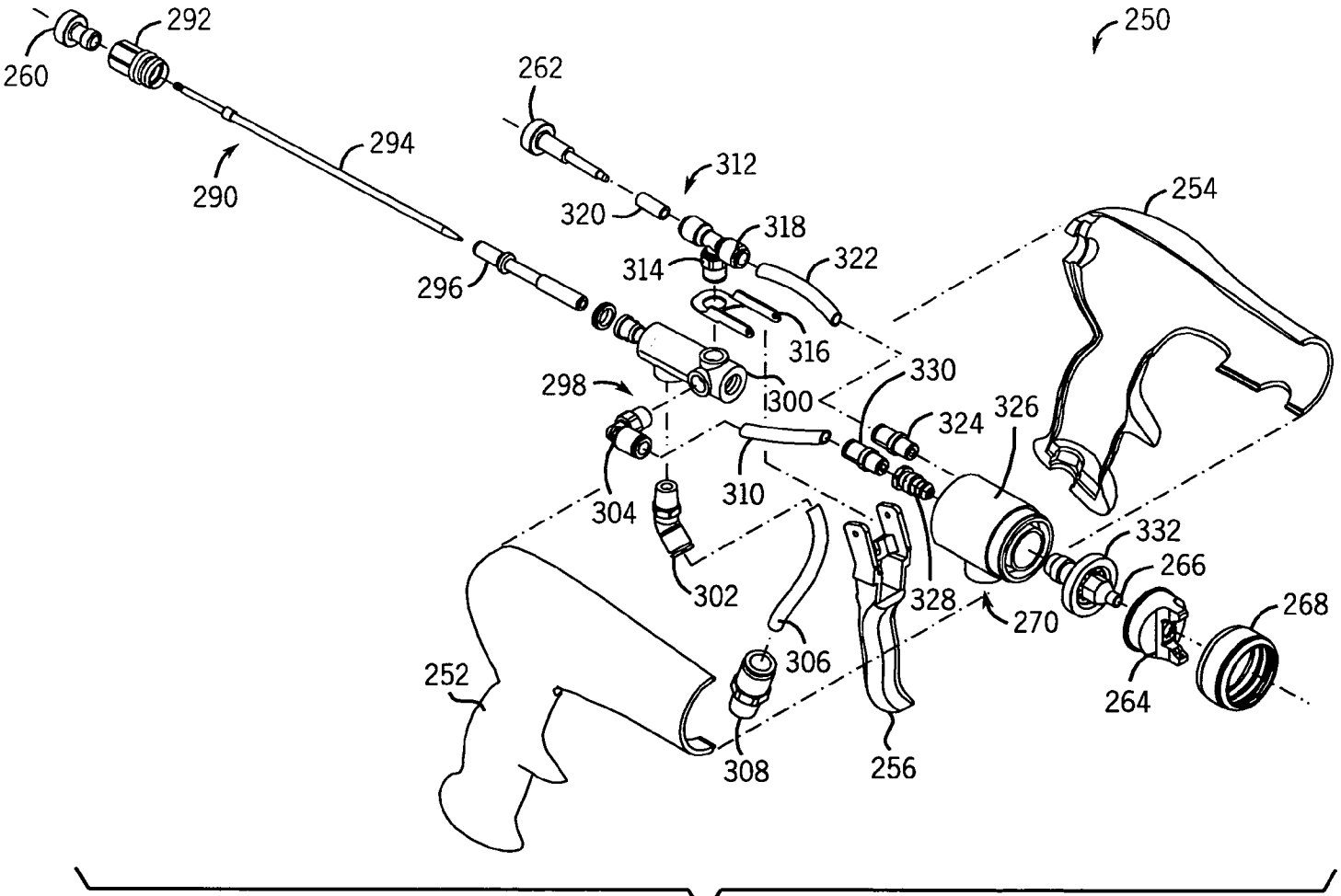
FIG. 5 is an exploded perspective view of an embodiment of the spray coating device as illustrated in FIG. 4 and associated modular components.

FIG. 5 is an exploded perspective view of an embodiment of modular components forming spray gun 250. The modular components forming spray gun 250 are coupleable to one another in a manner which facilitates full assembling or disassembling spray gun 250. For example, the modularity of spray gun 250 may be particularly advantageous, because it provides individual access, replacement, servicing, and maintenance of the various functional components of spray gun 250. In addition, modular components, such as modular tubing, can be used to easily connect and/or disconnect the aforementioned functional components. Typically, these various components would be integrally cast, machined, drilled, or otherwise fixed together within spray gun 250.

As illustrated, spray gun 250 includes a fluid needle module 290 having fluid valve adjuster 260 coupled to an adapter 292. Fluid needle module 290 also has a needle valve 294 coupled to fluid valve adjuster 260 via adapter 292. Needle valve 294 is adapted to move back and forth within the interior of spray gun 250 so as to let fluid pass through the spray coating device as trigger 256 is actuated. Fluid needle module 290 further includes an adapter 296 configured to couple fluid needle module 290, particularly, needle valve 294 to air valve module 298.

Air valve module 298 includes an air valve 300 coupleable to modular connectors 302 and 304. Modular connector 302 is adapted to deliver air from a pressurized air source or other air compressing devices to spray gun 250, via air tubing 306 and air adapter 308. Modular connector 304 is adapted to further deliver the pressurized air, via tubing 310 and additional adapters, from air tubing 306 to an air/fluid module 326 and exit tip 266 disposed at the front portion of spray gun 250. The pressurized air delivered to exit tip 266 may be fed into an atomization and fluid break up mechanism, which optimizes the spray formed when the spraying fluid exits spray gun 250.

Air valve module 298 is further coupled to a modular fan air control module 312 via adapters 314 and 316. Fan air control module 312 includes a fan air control valve 318 coupled to air valve adjuster 262 via adaptor 320. Fan air control module 312 is adapted to regulate the amount of pressurized air flowing into air valve module 298 and ultimately to fluid tip exit 266. Such air flow regulation may ensure that proper amounts of air and spray fluid are mixed to form a desirable spraying profile. Accordingly, fan air control module 312 is coupled to tubing 322 and adaptor 324, which in turn couple to air/fluid module 326. In some embodiments, fan air control module 312 may include one or more pinch valves, which externally compress or pinch a flexible tubing to open and close the fluid and/or air flow. For example, some embodiments may utilize the pinch valves to regulate the amount of air flowing into spray gun 250. Pinch valves may be particularly desirable to employ with modular spray coating devices, such as spray gun 250, because such valves are easily replaceable, relatively inexpensive, and degrade relatively less over time relative to conventional fan air control valves.

The illustrated air/fluid module 326 includes fluid inlet 270, which is adapted to receive fluid from a fluid conduit, a fluid container, or another fluid source. Air/fluid module 326 is further adapted to receive air from a pressurized air source via tubing 310 and adapters 328 and 330. In addition, air/fluid module 326 is coupled to fan air control module 312 via adapter 324, thereby enabling fan air control module 312 to control air flowing to air/fluid module 326. Air/fluid module 326 may include fluid mixing structures, such as internal air jets directed toward fluid flows, air-driven mixing structures, or internal fluid passages having variable geometries, or a combination thereof, to induce fluid mixing and breakup. In some embodiments, air flowing into air/fluid module 326 at a sufficient speed may lower the pressure enough within air/fluid module 326, such that spray fluid can be siphoned from the fluid source through fluid inlet 270.

As discussed below with reference to FIG. 7, spray gun 250 may be assembled such that fluid inlet 270 faces upwards. Such an alternate embodiment may be achieved during assembly of spray gun 250, as air/fluid module 326 is rotated so that fluid inlet 270 protrudes upwardly through casings 252 and 254. Such a configuration is employed for coupling spray gun 250 to fluid systems disposed above spray gun 250, for example, gravity-driven fluid delivery systems.

As further illustrated in FIG. 5, trigger 256 may be coupled to adapter 316, such that when assembled trigger 256 becomes disposed between air/fluid module 326 and air valve module 298. Accordingly, actuating trigger 256 causes air valve module 298 to open and/or close, thereby controlling the flow of air entering air/fluid module 326. Trigger 256 also may control fluid flow passing from inlet 270 through air/fluid module 326.

Air/fluid module 326 is further coupled to nozzle 332, such as a pintle nozzle, having fluid tip exit 266. Pintle nozzle 332 may be used in conjunction with air compressing atomization systems for transforming fluid provided by a fluid source into very fine droplets as the spray fluid exits spray gun 250 via exit 266. Pintle nozzle 332 is further coupled to air cap 264, which may be further coupled to air/fluid module 326. Air cap 264 and pintle nozzle 332 may both be coupled to air/fluid module 326 by retaining ring 264. In certain embodiments, air cap 264, pintle nozzle 332, and air/fluid module 326 may define a self contained removable spray head unit within spray gun 250.

Figure 6:
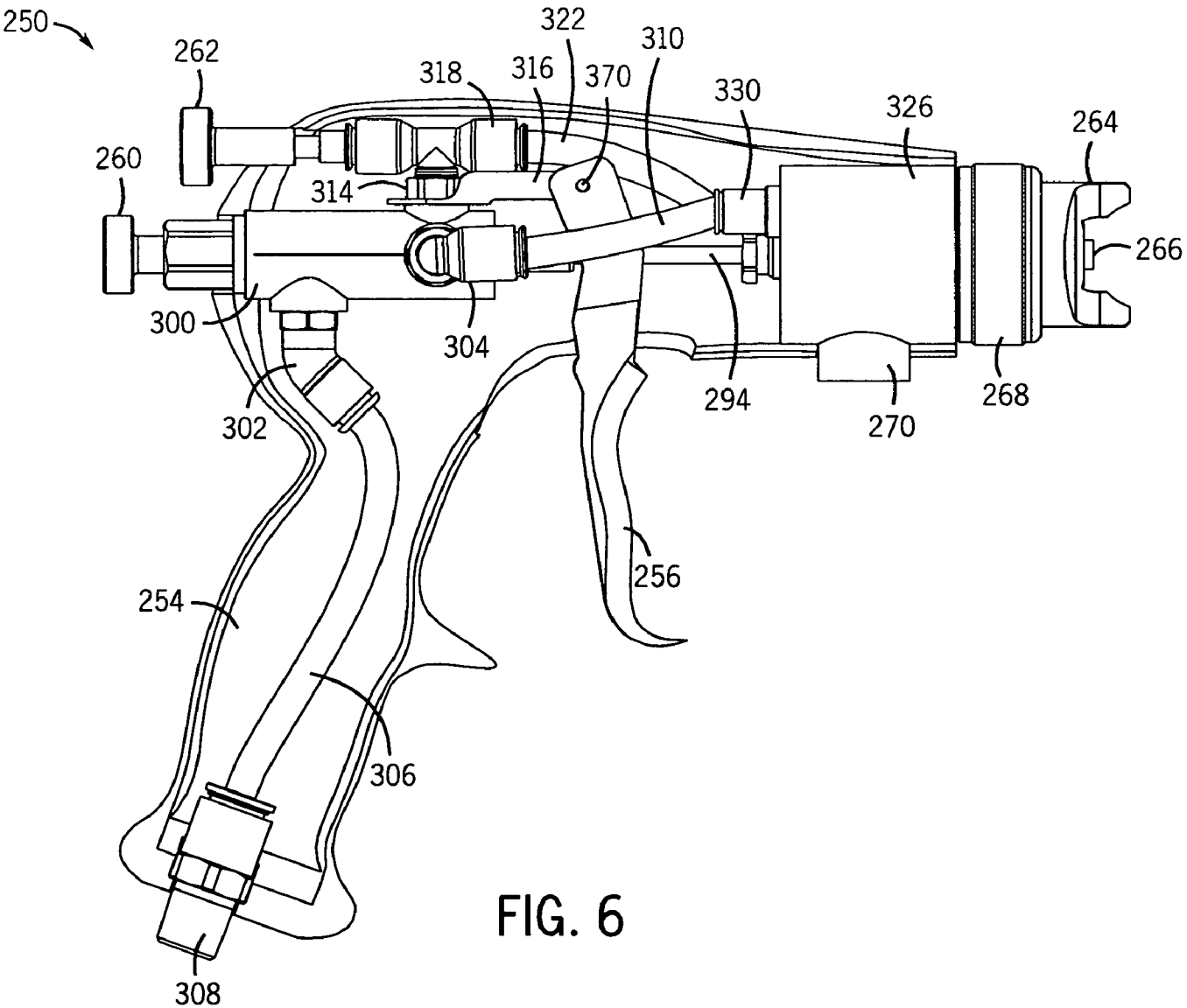
FIG. 6 is a side view of an embodiment of the spray coating device assembled with the modular components as illustrated in FIG. 5.
Figure 7:
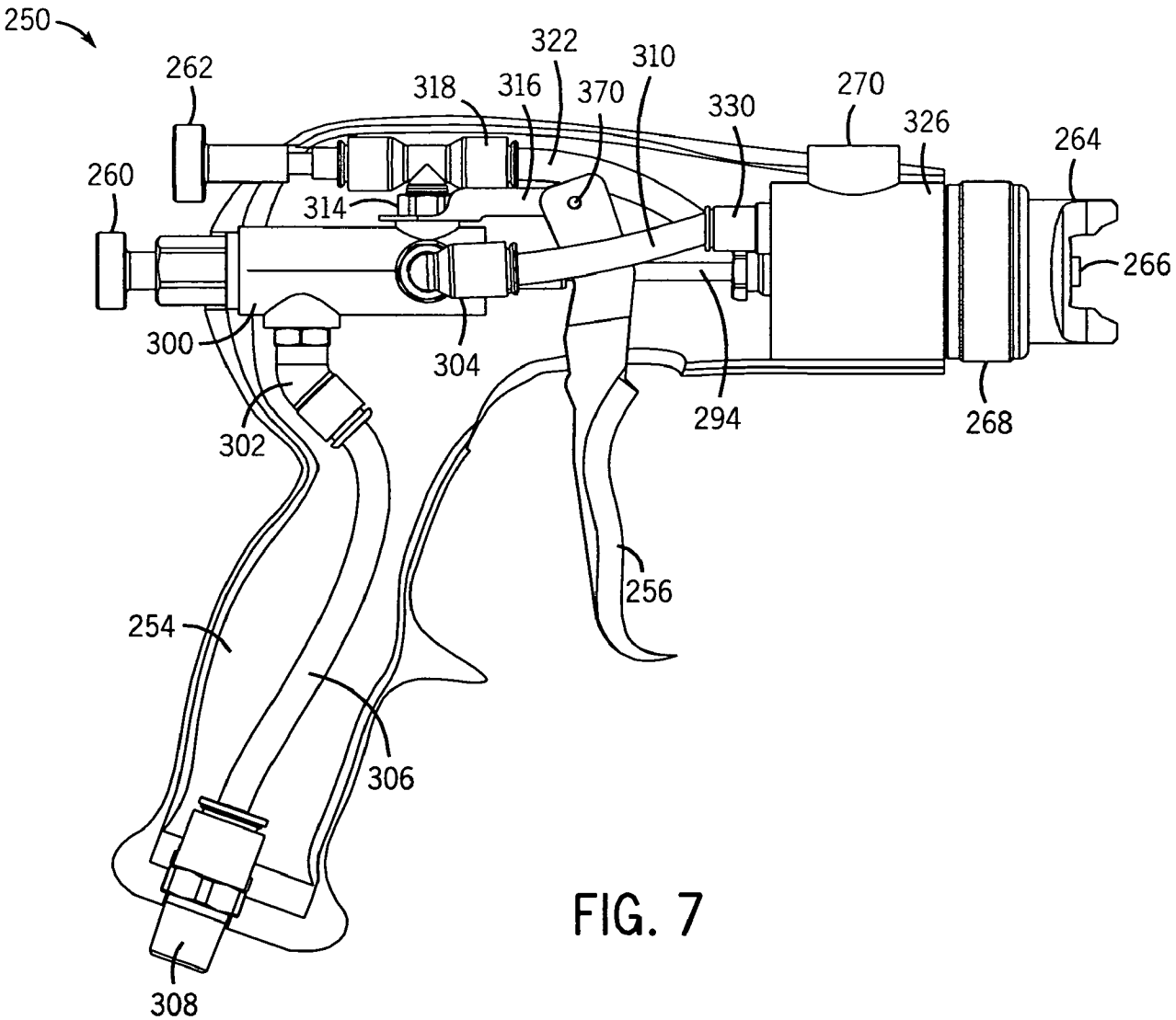
FIG. 7 is a side view of another embodiment of the spray coating device.

FIGS. 6 and 7 are side views of alternative embodiments of spray gun 250 as shown in FIGS. 4 and 5, further illustrating the various modular components assembled together inside enclosure 251. Specifically, FIGS. 6 and 7 depict spray gun 250 with modular casing 252 removed, thus, exposing assembled inner modular components of the spray coating device, such as those described in FIG. 5. Particularly, FIG. 6 depicts a configuration in which air/fluid module 326 is disposed within spray gun 250 such that fluid inlet 270 faces downward. Assembling spray gun 250 to have such a configuration adapts spray gun 250 to receive spray fluid from a fluid source disposed below spray gun 250. For example, the spray fluid may be fed by a pump, air pressure, or another suitable drive. In contrast, FIG. 7 depicts an alternative configuration of spray gun 250, wherein air/fluid module 326 is positioned with fluid inlet 270 facing upward. As discussed above, such a configuration adapts spray gun 250 to be coupled to fluid sources disposed above spray gun 250. That is, the configuration shown in FIG. 7 enables a gravity-driven fluid delivery system to be coupled to spray gun 250.

FIGS. 6 and 7 further depict the manner by which the above discussed modular components are assembled within spray gun 250. As illustrated, modular components of spray gun 250 may be replaced and/or removed from the spray coating device with relative ease and with minimal disassembly of components that are coupled to or are otherwise adjacent to the components being removed. For example, decoupling tubing 310 from adapters 304 and 330 may be done while leaving adapters 304 and 330 in place. Similarly, replacing trigger 256 with a different trigger (for example, to accommodate different gripping sizes) may be performed by decoupling trigger 256 from pivot joint 370 while maintaining adapter 316 and fan an air control module 312 in place. As further illustrated, the disclosed embodiments provide for a spray coating device having no machined or drilled passages permanently formed as part of the spray coating device. This further simplifies replacing, for example, tubing which may have become damaged, blocked, or otherwise degraded over time.

Figure 8:
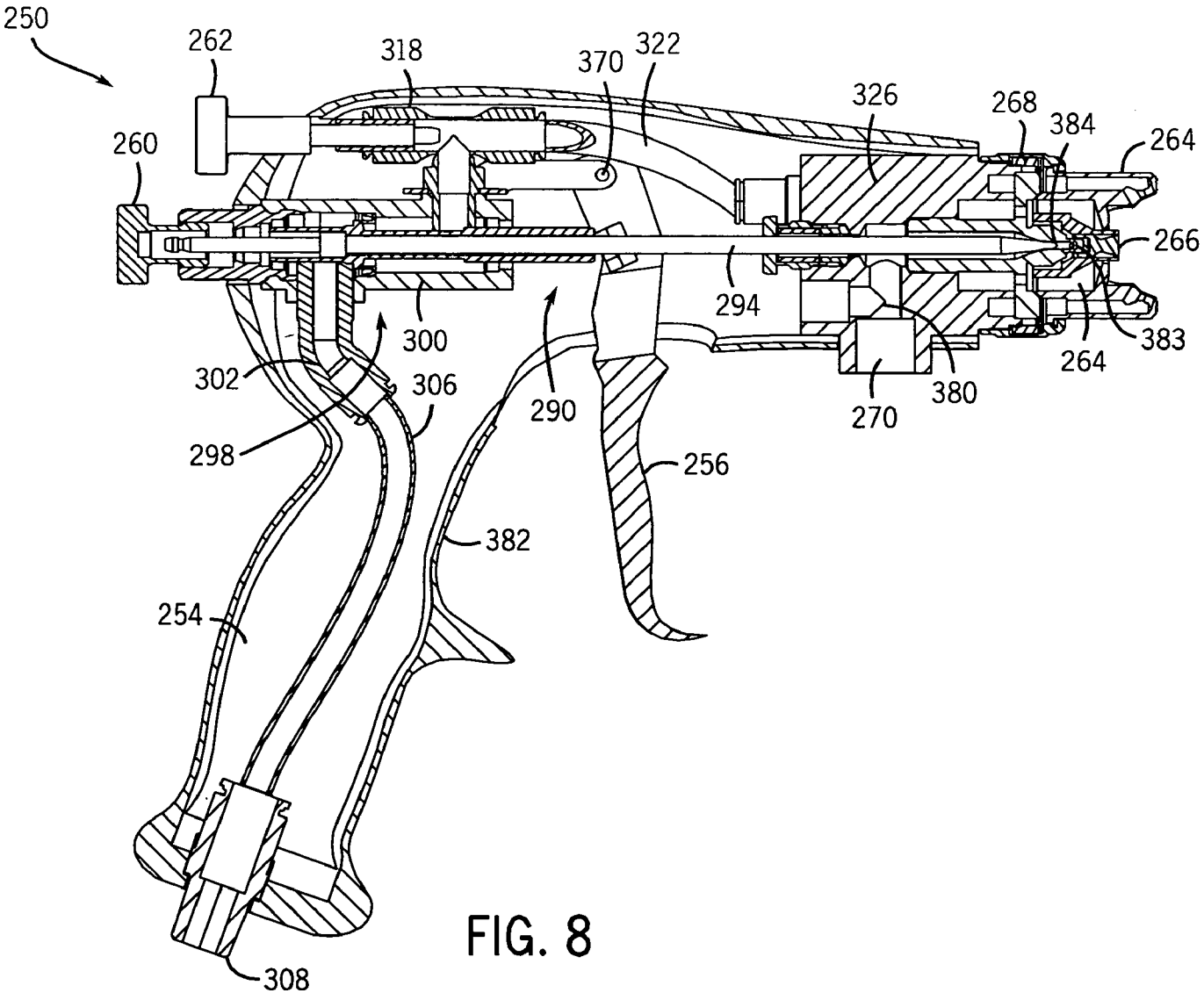
FIG. 8 is a cross-section view of an embodiment of the spray coating device as illustrated in FIG. 6.

FIG. 8 is a cross-section view of an embodiment of spray gun 250 shown in FIG. 6. As mentioned above, the interior space within modular casings 252 and 254 encapsulates a variety of modular components that can be quickly and easily replaced and/or removed from spray gun 250. As illustrated, fluid inlet 270 may extend from a fluid source, such as a fluid canister, to the interior of air/fluid module 326 via passage 380. Air/fluid module 326 is further coupled to fluid needle module 290, particularly, to needle valve 294 extending movably through spray gun 250 between exit tip 266 and fluid valve adjuster 260. Fluid valve adjuster 260 may be rotatably adjusted to correspondingly move needle valve 294 to a desired position within spray gun 250. Needle valve 294 is also coupled to trigger 256, such that needle valve 294 may be moved inwardly away from fluid exit tip 266 as trigger 256 is rotated clockwise about pivot joint 370. In this manner, trigger 256 can open and close needle valve 294, thereby controlling fluid flow through spray gun 250.

An air supply can be coupled to spray gun 250 via adapter 308. Air may be delivered, via tubing 306, to air valve module 298 to facilitate atomization at air cap 264 and exit tip 266. In the illustrated embodiment, air can be channeled from air valve 300 to air cap 264 through a passage in which needle valve 294 is slotted. Fan air control module 262 may include a variety of seal and valve assemblies, such as pinch valves and flow adjusters, for maintaining and regulating air pressure and flow through spray gun 250. As trigger 256 is rotated about the pivot joint 370, air valve module 298 enables air to flow from air tubing 306 to the passage leading to pintle nozzle 332. Trigger 256 is adapted to control closing or opening air valve module 298, thereby controlling the simultaneous flow of air and fluid to exit tip 266.

Pintle nozzle 332, exit tip 266, and air cap 264 may form a fluid delivery tip module that includes fluid breakup and fluid mixing components disposed within a central passage 383 of air cap 264. As further illustrated, needle valve module 290 has a needle tip 384 which abuts against an inner surface of pintle nozzle 332. Accordingly, as the user engages the trigger 256, the needle valve 294 moves tip 384 inwardly away from an abutment surface of central passage 383. The desired fluid then flows through pintle nozzle 332 and out through tip exit 266 to form a desired spray via the spray formation configuration described above.

Again, the modularity of the various components, for example, 290, 298, 312, and 326, and surrounding modular casings 252 and 254 enable simple assembly, disassembly, access, repair, replacement, maintenance, and reconfiguration when desired by a user. For example, rather than discarding an entire spray coating device or larger scale parts, individual modular components are accessible for cleaning, replacement of seals, or other tasks to reduce time and costs associating with operating spray gun 250. The modularity of the components also enables easy modification of spray gun 250. For example, one modular component can be replaced with a different modular component having different functions, geometries, orientations, and so forth. For example, as discussed above, module 326 may be rotated 180 degrees to orient inlet 270 at a top rather than a bottom of spray gun 250. Similarly, modular casings 252 and 254 may be replaced with other casings having different geometries, orientations for parts, functions, and so forth. In this manner, each set of casings 252 and 254 can be used with a variety of different modular components to provide a plurality of different spray gun configurations. Similarly, each of the modular components can be used with a variety of different casings 252 and 254. Thus, a large number of spray gun configurations can be provided with a much smaller number of modular components.

In addition, modular casings 252 and 254 are contrastingly different from typical solid cast bodies of spray coating devices, because casings 252 and 254 can be removed to reveal and provide access to the internal components. In other words, casings 252 and 254 define a hollow internal volume (not a solid cast interior), which has open spaces to receive and support the various modular components in a removable manner. In some embodiments, the interior volume may include distinct chambers with intermediate dividers, supports, and fasteners for the various modular components. However, other embodiments may rely on the interconnection of the modular components, and some connections with casings 252 and 254 (e.g., at front and rear portions).

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a liquid spray coating device, comprising:

a plurality of casings coupled together to define an exterior contour and a hollow interior of the liquid spray coating device;

a plurality of modular components disposed in the hollow interior, wherein the plurality of modular components cooperate with one another to output a liquid spray coating, each modular component is independent from the plurality of casings, each modular component is supported between the plurality of casings, and each modular component controls flow through the spray coating device;

a plurality of tubes disposed in the hollow interior, wherein the plurality of tubes couple together the plurality of modular components, each tube is independent from the plurality of casings, and each tube is supported between the plurality of casings;

a plurality of alternative modular components separate from the liquid spray coating device, wherein each alternative modular component replaces a respective modular component disposed in the hollow interior with a different flow control mechanism; and a storage case configured to support the plurality of alternative modular components independent from the liquid spray coating device.

2. The system of claim 1, wherein the plurality of modular components comprises a plurality of self-contained flow control units, wherein each of the self-contained flow control units comprises a housing that is disposed about and supports flow control elements that control fluid flow of the spray coating device.

3. The system of claim 2, wherein the self-contained flow control units comprise an air valve unit, a liquid valve unit, and an atomizing unit.

4. The system of claim 1, wherein the plurality of casings exclude any permanently formed passages.

5. The system of claim 1, wherein the plurality of tubes comprises a plurality of flexible tubes.

6. The system of claim 1, wherein the plurality of modular components comprise a first atomization module having a first atomization mechanism, and the plurality of alternative modular components comprise a second atomization module having a second atomization mechanism different from the first atomization mechanism.

7. The system of claim 6, wherein the first atomization module having the first atomization mechanism is configured to create a first spray shape, and the second atomization module having the second atomization mechanism is configured to create a second spray shape.

8. The system of claim 7, wherein the first atomization mechanism comprises a first set of air shaping ports configured to create the first spray shape, and the second atomization mechanism comprises a second set of air shaping ports configured to create the second spray shape.

9. The system of claim 6, wherein the first atomization module having the first atomization mechanism comprises an air atomization module, and the second atomization module having the second atomization mechanism comprises a liquid-only atomization module.

10. The system of claim 6, wherein the first atomization module having the first atomization mechanism or the second atomization module having the second atomization mechanism comprises a rotary atomization module.

11. The system of claim 6, wherein the first atomization module having the first atomization mechanism or the second atomization module having the second atomization mechanism comprises an electrostatic atomization module.

12. The system of claim 1, wherein the plurality of modular components comprises a pinch valve configured to externally compress one of the plurality of tubes.

13. The system of claim 1, wherein the plurality of modular components comprises an air/liquid module, and the plurality of tubes comprises an air tube and a liquid tube coupled to the air/liquid module.

14. The system of claim 13, wherein the air/liquid module comprises air/liquid valve module configured to control flow of both air and liquid.

15. The system of claim 13, wherein the air/liquid module comprises an air atomization spray head having a liquid port and an air port.

16. The system of claim 13, wherein the air/liquid module is reconfigurable in a gravity feed orientation having a liquid inlet facing up and a pressure feed configuration having the liquid inlet facing down.

17. A system, comprising:

a liquid spray coating device, comprising:

a plurality of casings coupled together to define an exterior contour and a hollow interior of the liquid spray coating device;

an air/liquid module disposed in the hollow interior, wherein the air/liquid module is reconfigurable in a gravity feed orientation having a liquid inlet facing up and a pressure feed configuration having the liquid inlet facing down, the air/liquid module is independent from the plurality of casings, and the air/liquid module is supported between the plurality of casings;

a first valve module disposed in the hollow interior, wherein the first valve module is independent from the plurality of casings, the first valve module is supported between the plurality of casings, and the first valve module comprises a valve needle extending through the hollow interior from the first valve module to the air/liquid module; and a first air tube disposed in the hollow interior, wherein the first air tube is coupled to the air/liquid module and the first valve module, the first air tube is independent from the plurality of casings, and the first air tube is supported between the plurality of casings.

18. The system of claim 17, wherein the liquid spray coating device comprises a second valve module and a second air tube disposed in the hollow interior, the second valve module and the second air tube are independent from the plurality of casings, the second valve module and the second air tube are supported between the plurality of casings, the second air tube is configured to supply air from the second valve module to air shaping ports in the air/liquid module, the first air tube is configured to supply air from the first valve module to an air atomization port in the air/liquid module, and the valve needle is configured to control liquid flow in the air/liquid module.

19. A system, comprising:

a liquid spray coating device, comprising:

a plurality of casings coupled together to define an exterior contour and a hollow interior of the liquid spray coating device;

an air/liquid atomization module disposed in the hollow interior, wherein the air/liquid atomization module is independent from the plurality of casings, and the air/liquid atomization module is supported between the plurality of casings;

a first air tube disposed in the hollow interior, wherein the first air tube is coupled to the air/liquid atomization module, the first air tube is independent from the plurality of casings, and the first air tube is supported between the plurality of casings;

a first valve module disposed in the hollow interior, wherein the first valve module is coupled to the air/liquid atomization module, the first valve module is independent from the plurality of casings, the first valve module is supported between the plurality of casings, and the first valve module controls air flow through the first air tube to an air atomization port in the air/liquid atomization module;

a second air tube disposed in the hollow interior, wherein the second air tube is coupled to the air/liquid atomization module, the second air tube is independent from the plurality of casings, and the second air tube is supported between the plurality of casings; and a second valve module disposed in the hollow interior, wherein the second valve module is coupled to the air/liquid atomization module, the second valve module is independent from the plurality of casings, the second valve module is supported between the plurality of casings, and the second valve module controls air flow through the second air tube to a plurality of air shaping ports in the air/liquid atomization module.

20. The system of claim 19, wherein the first valve module is directly coupled to the second valve module, the first valve module comprises a valve needle extending from the first valve module into the air/liquid atomization module, and a third air tube is coupled to the first valve module.

* * * * *